United States Patent [19]

Schreurs

[11] 4,289,991

[45] Sep. 15, 1981

[54] FLUORESCENT LAMP WITH A LOW REFLECTIVITY PROTECTIVE FILM OF ALUMINUM OXIDE

[75] Inventor: Willy P. Schreurs, Danvers, Mass.

[73] Assignee: GTE Products Corporation, Stamford, Conn.

[21] Appl. No.: 830,702

[22] Filed: Sep. 6, 1977

Related U.S. Application Data

[63] Continuation of Ser. No. 526,755, Nov. 25, 1974, abandoned.

[51] Int. Cl.[3] ..... H01J 61/35; H01J 61/42

[52] U.S. Cl. ..... 313/489; 313/493; 313/221; 313/492

[58] Field of Search ..... 313/489, 493, 220, 221, 313/492

[56] References Cited

U.S. PATENT DOCUMENTS

| | | | |
|---|---|---|---|
| 3,624,444 | 11/1971 | Berthold et al. | 313/489 X |
| 3,717,781 | 2/1973 | Sadoski et al. | 313/489 X |
| 3,967,153 | 6/1976 | Milke et al. | 313/489 |

*Primary Examiner*—Palmer C. Demeo

*Attorney, Agent, or Firm*—James Theodosopoulos

[57] ABSTRACT

The light output and lumen maintenance of fluorescent lamps with or without a conductive film, are improved by coating the glass envelope or the conductive glass envelope with a thin transparent film of $Al_2O_3$.

The alumina film is obtained from a coating of a binderless suspension of submicron size $Al_2O_3$ particles in lightly acidified water and has a thickness of 20 to 80 nanometers.

1 Claim, No Drawings

FLUORESCENT LAMP WITH A LOW REFLECTIVITY PROTECTIVE FILM OF ALUMINUM OXIDE

This appln. is a continuation of Ser. No. 526,755, 11-25-74, abandoned.

BACKGROUND OF THE INVENTION

1. Field of the Invention

This invention concerns fluorescent lamps, which are electric lamps comprising a glass envelope having a coating of phosphor on its inner surface, which have electrodes at each end and which contain a fill including low pressure mercury vapor.

This invention particularly relates to protective coatings applied to conventional fluorescent lamp glass envelopes.

2. Description of the Prior Art

It is well known in the art that the light output and the lumen maintenance of fluorescent lamps are affected by a progressive darkening of the bulb during the useful life of the lamp. The darkening is commonly attributed to disclorations resulting from the amalgamation of mercury with sodium at the inner surface of the glass under the influence of impinging ultraviolet radiations. Mercury is present in the lamp fill and sodium is present in the glass.

In a special type of fluorescent lamp the inner surface of the glass is coated with a transparent electroconductive layer of tin oxide or indium oxide in order to achieve satisfactory ignition characteristics. In this particular case, the darkening is compounded by additional discolorations resulting from the conductive coating. This is particularly true of the white conductive $SnO_2$ which can be reduced to the black SnO.

Many types of protective coatings in fluorescent lamps have been disclosed most of which are relatively thick and porous due to the method of application by dispersion in an organic binder followed by the conventional coating, drying and baking process.

Such is the case for a coating of zinc oxide, titanium oxide or cerium oxide disclosed in U.S. Pat. No. 2,774,903, issued to L. Burns, Dec. 18, 1956.

In U.S. Pat. No. 3,141,990, issued to J. G. Ray, July 12, 1964, the $TiO_2$ is 12 to 25 microns thick.

Another thick layer of $TiO_2$ is disclosed in U.S. Pat. No. 3,379,917, issued Apr. 23, 1968 to R. Menelly and an alumina layer of 1 to 10 microns thick with a thin layer of titania is disclosed in U.S. Pat. No. 3,599,029, issued Aug. 10, 1971 to Martyny.

While the thick protective layers achieve some improvement in maintenance, they also introduce the disadvantage of reducing the initial light output.

In order to reduce the initial light loss, much thinner coatings of $TiO_2$ and $ZrO_2$ have been disclosed, as in U.S. Pat. No. 3,377,494 to R. W. Repsher on Apr. 9, 1968.

However, thin films of $TiO_2$ have been noted to cause starting problems in fluorescent lamps, hence the disclosure of $Sb_2O_3$ additions to such films in U.S. Pat. No. 3,541,376, issued Nov. 17, 1970 to Sadoski and Schreurs.

In U.S. Pat. No. 3,748,518, issued June 14, 1972 to D. Lewis, it is stated that a titania film 10 to 20 nanometers thick reflects the ultra violet radiation back into the phosphor. U.S. Pat. No. 3,624,444, issued to F. Berthold on Nov. 30, 1971 discloses the necessity of protective layers over tin oxide conductive films to prevent the formation of black stains already occurring after 50 operating hours. In this case, the protective layers have a thickness of 50 to 150 nanometers and consist of oxides of titanium, zirconium, hafnium, niobium and tantalum.

Very thin films with a thickness less than 200 nanometers have so far only been produced by vapor deposition or from hydrolyzed solutions of relatively expensive metal organic compounds such as tetraisopropyl titanate or titrabutyl titanate and require elaborate controls to produce the required thickness with reproducible accuracy.

SUMMARY OF THE INVENTION

The object of the invention is to provide a protective coating within a fluorescent lamp which will improve the maintenance while increasing the initial light output. A further object is to provide a film which is most economical and easily applicable to high speed production.

In accordance with the invention, the increase in inital light output is achieved by a compact film of aluminum oxide between 20 and 80 nanometers thick acting as an anti-reflective layer for the visible light. In addition, the film of $Al_2O_3$ acts as a protective barrier between the glass and the phosphor or between the conductive layer and the phosphor in the electroconductive fluorescent lamps. According to my preferred process, the film of $Al_2O_3$ is applied by flushing down the bulb an aqueous dispersion of fumed alumina having a surface area of 100 $m^2$/gram minimum and drying the film with hot air or preferably by zone drying, as disclosed in my U.S. Pat. No. 3,676,176. The phosphor coating is then applied in the usual manner using an organic binder. A single lehring is sufficient and the fluorescent lamp is processed in the manner known in the art.

DESCRIPTION OF THE PREFERRED EMBODIMENT

Fumed alumina with a surface area equal or greater than 100 $m^2$ per gram is commercially available and can readily be suspended in water with homogenizers or colloid mills. The fluidity of such suspensions depends on the concentration and the pH and the latter can be adjusted with mineral or organic acids. I found it very convenient to prepare fumed alumina suspensions containing 30% solids by weight. The pH of the suspension is adjusted to a value between 2 and 4 with a slight addition of HCL. Such dispersions remain stable for months and can be diluted with water to the desired concentration level. In preparing the $Al_2O_3$ coating according to the invention, advantage is taken of the exceptional positive surface charge developed by the fumed alumina particles in aqueous or other highly polar suspensions. This positive charge renders the resulting films highly substantive to glass and, consequently, very strongly adherent to the glass envelope of the fluorescent lamp. This strong adherence is still maintained if the glass has been previously coated with an electroconductive tin oxide or indium oxide film. Furthermore, the subsequent phosphor layer which normally has a slight negative charge is now substantive to the positively charged $Al_2O_3$ layer. In consequence, the interpostion of my $Al_2O_3$ layer between the glass surface and the phosphor film results in increased overall adherence and reduces the manufacturing losses due to knocking or shaping the fluorescent lamp envelope.

As a specific example of protective coatings in fluorescent lamps, a series of 40T12 fluorescent lamp bulbs were coated at different concentrations of $Al_2O_3$ in order to determine the optimum thickness of $Al_2O_3$ film. The coatings were obtained by diluting a 30% solids by weight fumed alumina suspension with deionized water and adding a suitable wetting agent to insure a complete coverage of the glass envelope during the down-flushing. A most satisfactory wetting was obtained by adding an ampholytic surfactant at a concentration of 0.5% in the final coating.

After flushing, the glass bulbs were dried by the zone drying method using radiant heaters. Such drying is most efficient since it requires about 60 seconds for a 4 foot bulb. After drying the bulbs were coated with a cool white halophosphate phosphor dispersed in an organic vehicle and processed into lamps in the manner well known in the art.

The light output of these lamps is given in the following table expressed in percent relative to the control.

| RELATIVE LIGHT OUTPUT VERSUS $Al_2O_3$ CONCENTRATION | 100 HOURS | 500 HOURS | 1750 HOURS |
|---|---|---|---|
| 1. 12 mg $Al_2O_3$/ml | 100.1 | 99.7 | 101.0 |
| 2. 18 mg $Al_2O_3$/ml | 100.6 | 101.5 | 103.0 |
| 3. 24 mg $Al_2O_3$/ml | 101.4 | 101.5 | 103.0 |
| 4. 30 mg $Al_2O_3$/ml | 101.3 | 101.5 | 102.4 |
| 5. 36 mg $Al_2O_3$/ml | 100.5 | 99.4 | 100.0 |
| 6. 60 mg $Al_2O_3$/ml | 100.0 | 98.5 | — |
| Control - no precoat | 100 % | 100 % | 100 % |

It is quite apparent from these results that the most efficient film was obtained under the operating conditions, at a concentration of 24 mg/ml of $Al_2O_3$ in the coating. Electron micrographs of this particular film revealed a very thin compact layer of $Al_2O_3$ approximately 50 nanometers thick.

In another example of $Al_2O_3$ coatings according to the invention, a direct comparison was established between regular fluorescent lamps at various gas compositions and similar lamps with a conductive film of indium oxide overcoated with the $Al_2O_3$ film. Conductive films whether of indium or stannic oxide, are known to cause a brightness loss. The conductive film in this test was overcoated with an aluminum oxide coating at 24 mg $Al_2O_3$ per ml prepared and laid on in the manner described in the previous example. The results given in the followng tables show that the $Al_2O_3$ film according to the invention more than compensates for the light loss that would result from a conductive film.

| CONTROL LAMPS, NO CONDUCTIVE FILM, NO $Al_2O_3$ FILM | | | |
|---|---|---|---|
| GAS FILL | O HOURS | 100 HOURS | 500 HOURS |
| 100% Argon | 3199 lumens | 3064 lumens | 3014 lumens |
| 65% Argon | 3004 lumens | 2874 lumens | 2844 lumens |
| 50% Argon | 2941 lumens | 2830 lumens | 2806 lumens |
| Average Brightness | 3048 lumens | 2923 lumens | 2888 lumens |

| TEST LAMPS WITH INDIUM OXIDE FILM, PLUS $Al_2O_3$ FILM | | | |
|---|---|---|---|
| GAS FILL | O HOURS | 100 HOURS | 500 HOURS |
| 100% Argon | 3194 lumens | 3098 lumens | 3042 lumens |
| 65% Argon | 3039 lumens | 2899 lumens | 2870 lumens |
| 50% Argon | 2979 lumens | 2832 lumens | 2798 lumens |
| Average Brightness | 3071 lumens | 2943 lumens | 2903 lumens |

In another test a direct comparison was established between a group of regular lamps, another group with a tin oxide conductive coating and finally a group which contained the aluminum oxide protective coating according to the invention, over the conductive tin oxide film. This coating had again been obtained in a manner similar to that described in the first example and at the optimum 24 mg $Al_2O_3$ per ml concentration.

| | O HOUR | 100 HOURS | MAINTENANCE |
|---|---|---|---|
| Control lamp-phosphor alone | 2796 lumens | 2664 lumens | 95.3% |
| $SnO_2$ film and phosphor | 2727 lumens | 2559 lumens | 93.8% |
| $SnO_2$ film - $Al_2O_3$ film and phosphor | 2755 lumens | 2662 lumens | 96.6% |

I claim:

1. In a fluorescent lamp comprising a sealed glass envelope containing a fill including low pressure mercury vapor, the improvement which comprises an antireflective film of aluminum oxide disposed on an electroconductive layer adhering to the inner surface of the glass envelope, wherein the thickness of the antireflective film is such as to increase both initial light output and lumen maintenance of the lamp.

* * * * *